US006764236B2

(12) United States Patent
Suzuki

(10) Patent No.: US 6,764,236 B2
(45) Date of Patent: Jul. 20, 2004

(54) SHEET GUIDE DEVICE AND IMAGE FORMING APPARATUS

(75) Inventor: Kenji Suzuki, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/383,055

(22) Filed: Mar. 7, 2003

(65) Prior Publication Data

US 2003/0175060 A1 Sep. 18, 2003

(30) Foreign Application Priority Data

Mar. 13, 2002 (JP) ..... 2002-069263

(51) Int. Cl.[7] ..... B41J 13/10; G03G 15/00

(52) U.S. Cl. ..... 400/642; 400/188; 101/230; 271/185; 271/303; 399/401

(58) Field of Search ..... 101/229, 230, 101/231, 232; 400/188, 642; 399/364, 373, 374, 401, 405; 271/184, 185, 187, 302, 303, 304, 305

(56) References Cited

U.S. PATENT DOCUMENTS 5,350,166 A 9/1994 Shimizu et al. ..... 271/14
5,625,444 A 4/1997 Suzuki et al. ..... 399/400
5,655,765 A * 8/1997 Asami et al. ..... 271/185
5,729,816 A 3/1998 Matsumoto et al. ..... 399/381
6,129,349 A * 10/2000 Olbrich et al. ..... 271/186
6,186,497 B1 * 2/2001 Johnston ..... 271/186
6,262,752 B1 7/2001 Suzuki et al. ..... 346/134
6,323,939 B1 11/2001 Suzuki ..... 355/407
6,350,072 B1 * 2/2002 Nunes et al. ..... 400/188
6,398,212 B1 * 6/2002 Miyake ..... 271/186
6,473,579 B1 10/2002 Suzuki et al. ..... 399/124

* cited by examiner

*Primary Examiner*—Ren Yan
(74) *Attorney, Agent, or Firm*—Fitzpatrick, Cella, Harper & Scinto

(57) ABSTRACT

A sheet guide device, which includes: a branch-off sheet guide path that is branched off from a sheet guide path that guides a sheet; a guide member that is rotatably disposed in a branch-off portion of the branch-off sheet guide path and selectively guides the sheet to respective sheet guide paths that are branched off in the branch-off sheet guide path; and a guide rotary member that is located in the branch-off portion and capable of rotating in a sheet transport direction, in which a rotational surface of the guide rotary member is protruded from a sheet guide surface of the guide member which guides the sheet.

13 Claims, 13 Drawing Sheets

SHEET GUIDE DEVICE AND IMAGE FORMING APPARATUS

BACKGROUND OF THE INVENTION

1. Field of the Invention

The present invention relates to a sheet guide device for guiding a sheet passing through a branch-off guide path that is branched off, and an image forming apparatus that includes the sheet guide device in an apparatus main body and causes the sheet on which an image has been formed to be guided by the sheet guide apparatus.

2. Related Background Art

In recent years, image forming apparatuses such as copying machines, printers, facsimiles, and all-in-one machines integrating their functions have become widely popular. These image forming apparatuses have been structured based on the copying machines. However, in association with the recent rapidly widespread use of personal computers, the image forming apparatuses structured based on the printers are now becoming mainstream. Also, it has become common practice that the image forming apparatuses employ duplex printing in which images are formed on both surfaces of the sheet from the viewpoints of environmental protection, resource savings, and the like. Thus, various models of the image forming apparatuses including a duplex image forming function are increasing in number.

In addition, the duplex image forming function of the image forming apparatus is being enhanced and the size thereof is being reduced. This trend leads to the necessity of sharply shifting a sheet transport direction of transporting the sheet within the apparatus main body. As a result, it has become essential to make smaller than ever the radius of curvature of the sheet guide path for guiding the sheet.

FIG. 11 is a schematic sectional view of a printer as an example of the conventional image forming apparatuses which is taken along a sheet transport direction.

In a printer 130 as shown in FIG. 11, a toner image is transferred onto a sheet P fed from a sheet feed portion 101 in an image forming portion 102. The sheet is then passed through a fixing device, so that the toner image is fixed to the sheet. Immediately after that, a transport path switch gate 111 is switched to thereby select the sheet transport direction. The subsequent transport paths are bent by approximately 90 degrees. Due to the switching of the transport path switch gate 111, the sheet is delivered to a face down tray (hereinafter, referred to as "FD tray") 106 or selectively transported to a surface reverse transport path 119. The sheet whose surfaces have been reversed in the surface reverse transport path 119 is transported in a switch back manner in the surface reverse transport path 119, and then, a front surface and a back surface of the sheet are reversed. After that, the sheet is passed along a duplex transport path 120, and again sent to the image forming portion 102 and the like, so that another toner image is formed on the other surface. Accordingly, toner images are formed on both surfaces of the sheet. The sheet of which surfaces both have a toner image formed thereon is passed through the fixing device 103. Finally, the sheet is delivered to the FD tray 106.

Incidentally, in recent years, the cases where color printers are used to output high density color images have been increased in offices, homes, and the like regardless of special places. This is because the high density color images are often used as backgrounds (solid images as backgrounds) in preparing materials for presentations or the like, or because color photo images and the like are often outputted due to the widespread use of digital cameras.

Also, in the fixing devices of the color printers, compared with the fixing devices of conventional black-and-white printers, a larger amount of toner must be fused and fixed to the sheet. Therefore, for example, in the case where the fixing device is of a fixing roller type, a long period of time is necessary for the sheet to be passed through a fixing nip portion in the fixing device.

Accordingly, the sheet on which the toner image is formed in the color printer exits the fixing device with its surface remaining at a higher temperature than in the case where the toner image is formed in the conventional black-and-white printer. In general, the heat quantity supplied to the fixing device of the color printer is approximately 2 to 3 times larger than the fixing device of the black-and-white printer. In addition, in accordance with the downsizing of the printers, it is demanded to provide immediately after the fixing device a bend and transport path in which the direction of a sheet transport path is shifted by approximately 90 degrees in the transport path switch gate.

However, in the small-sized color printer under the above-mentioned circumstances, the sheet is bent and transported while a high density color image surface of the sheet is in contact with the transport path switch gate. Therefore, failure easily occurs in bending and transporting the sheet.

First, as a condition that the failure occurs most in bending and transporting the sheet, there is a case where, in the duplex printing in which toner images are formed on both surfaces of the sheet, a high density toner image is printed on the first surface. That is, the sheet in which the toner image has been transferred onto and fixed to the first surface is guided by the transport path switch gate 111 to be passed along the surface reverse transport path and the duplex transport path. When another toner image is then formed on the second surface and the sheet is passed through the fixing device 103 again, there is a case where the high density toner image on the reversed first surface which has been once fixed is fused by the heat of the fixing device 103. Immediately after that, before the toner of the fused toner image is completely cooled down to become hard, the sheet transport path is shifted upward by approximately 90 degrees in FIG. 11 by the transport path switch gate 111. Therefore, in some cases, due to the transport resistance applied when the sheet P is bent and transported upward, the self weight of the sheet P on which the high density image has been formed, and the like, the back surface of the sheet P is pressed against the transport path switch gate 111 and the toner surface of the back surface adheres to the transport path switch gate 111. This leads to the failure in transporting the sheet P.

In this case, in the periphery of a distal end portion of the sheet P, even if there is a slight adhesion resistance with respect to the transport path switch gate 111, the sheet can be transported by the transport force of a fixing roller pair 104 of the fixing device 103 or a fixing delivery roller pair 105. However, as shown in FIG. 12, in accordance with the sheet P being transported upward, the transport resistance of the sheet, the self weight of the sheet on which the high density image has been formed, and the like increases, thereby making it difficult to transport the sheet. The transport resistance of the sheet becomes largest immediately before the distal end of the sheet reaches a delivery sheet vertical pass roller 112 subsequent to the transport path switch gate 111. Thus, the force by which the toner surface of the back surface is pressed against the transport path switch gate 111 is also largest, so that there is a case where the adhesion of the sheet is caused and the failure in transporting the sheet occurs in the printer 130.

Second, as the failure that less often occurs than the above failure, there is a similar case where, in the duplex printing in which a toner image is formed on both surfaces of the sheet, when the sheet whose first surface having a high density image printed thereon is guided by the transport path switch gate 111 and transported to the surface reverse transport path 119, the adhesion of the sheet to the transport path switch gate 111 is caused as shown in FIG. 13. That is, there is a case where the high density image transferred onto and fixed to the first surface is fused by the heat of the fixing device 103. Immediately after that, before the toner of the fused toner image is completely cooled down to become hard, the sheet transport path is shifted downward by approximately 90 degrees in FIG. 13 by the transport path switch gate 111. Therefore, due to the self weight of the sheet on which the high density image has been formed and the like, the force is applied to the sheet in the direction for pulling the front surface thereof apart from the transport path switch gate 111. However, due to the transport force of the fixing device 103, the sheet is pressed against the gate surface of the transport path switch gate 111, so that there is a case where the toner surface of the front surface adheres to the gate member, which leads to the failure in transporting the sheet.

SUMMARY OF THE INVENTION

The present invention has an object to provide a sheet guide device for guiding the sheet smoothly without causing a phenomenon of sheet adhesion to a guide member, which is disposed in a branch-off portion of a branch-off sheet guide path, selects a guide path for the sheet, and guides the sheet and an image forming apparatus having the sheet guide device in an apparatus main body thereof which guides the sheet on which an image has been formed to the sheet guide device.

In order to achieve the above object, according to one aspect of the present invention, a sheet guide device includes:

a branch-off sheet guide path that is branched off from a sheet guide path that guides a sheet;

a guide member that is rotatably disposed in a branch-off portion of the branch-off sheet guide path and selectively guides the sheet to respective sheet guide paths that are branched off in the branch-off sheet guide path; and a guide rotary member that is located in the branch-off portion and capable of rotating in a sheet transport direction, and in the sheet guide device, a rotational surface of the guide rotary member is protruded from a sheet guide surface of the guide member which guides the sheet.

According to another aspect of the present invention, an image forming apparatus includes:

image forming means for forming a toner image on a sheet;

fixing means for fixing the toner image to the sheet on which the toner image has been formed by the image forming means;

a branch-off sheet guide path that is branched off from a sheet guide path that guides the sheet on a downstream side of the fixing means;

a guide member that is rotatably disposed in a branch-off portion of the branch-off sheet guide path and selectively guides the sheet to respective sheet guide paths that are branched off in the branch-off sheet guide path; and a guide rotary member that is located in the branch-off portion and capable of rotating in a sheet transport direction, and in the image forming apparatus, a rotational surface of the guide rotary member is protruded from a sheet guide surface of the guide member which guides the sheet.

DESCRIPTION OF THE PREFERRED EMBODIMENTS

Hereinafter, descriptions will be made, with reference to the drawings, of a sheet guide device according to an embodiment of the present invention which is in a guide path crossing portion and a printer which is an example of an image forming apparatus provided with the sheet guide device in an apparatus main body thereof.

Figure 1:
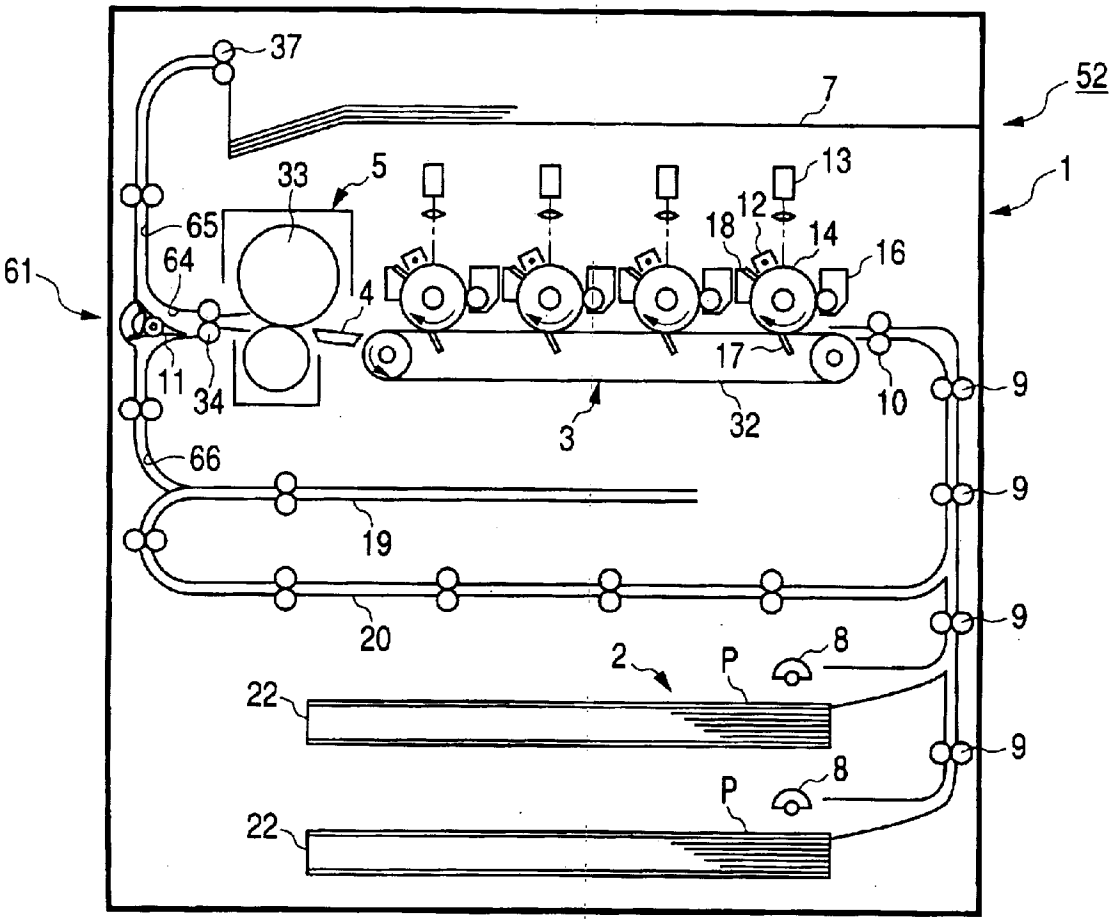
FIG. 1 is a schematic sectional view of a printer taken along a sheet transport direction, the printer being provided in an apparatus main body thereof with a sheet guide device according to Embodiment 1 of the present invention.

FIG. 1 is a schematic sectional view of the printer taken along a sheet transport direction, the printer being provided in the apparatus main body with the sheet guide device which is in the guide path crossing portion.

The apparatus main body 1 of the printer 52 is composed of: a sheet feed portion 2 that stacks and contains therein sheets P on which an image is to be formed and sends out the sheets P one by one to an image forming portion 3 serving as image forming means; the image forming portion 3 that forms a toner image on the sheet; a transport portion 4 that further transports the sheet onto which the toner image has been transferred; a fixing device 5 that serves as fixing means for fixing the toner image on the transported sheet to the sheet substantially permanently; a sheet guide device 61 that guides the sheet to which the toner image has been fixed; and the like.

Figure 2:
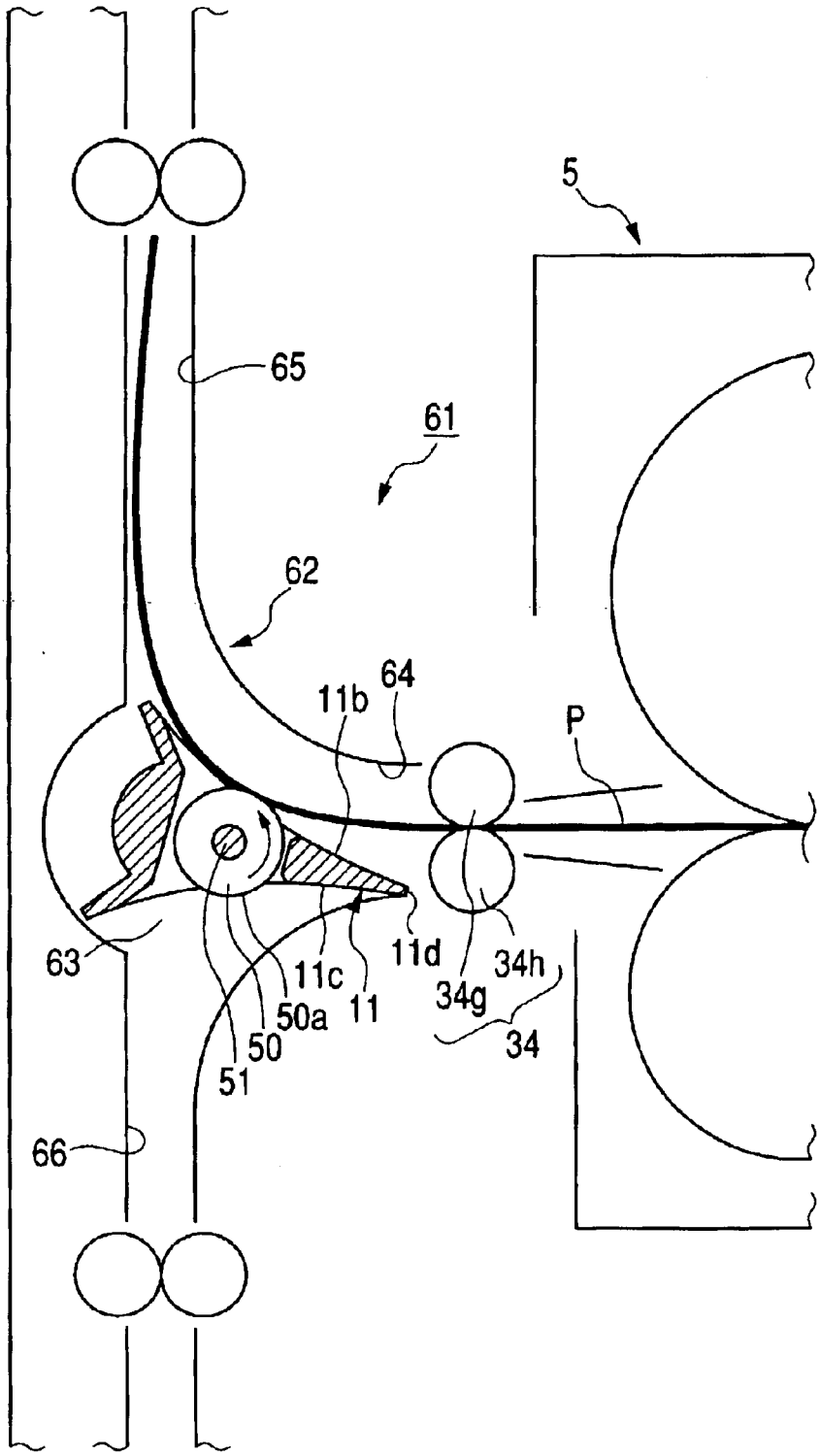
FIG. 2 is a schematic sectional view of the sheet guide device according to Embodiment 1 of the present invention which is taken along the sheet transport direction, and shows a case where a sheet is guided to a face down tray.

A sheet is sent out from the sheet feed portion 2, a toner image is formed on the sheet in the image forming portion 3, and then, the toner image is fixed to the sheet in the fixing device 5. The sheet after the fixing of the toner image thereto is guided to a transport path switch gate 11 in a position as indicated in FIGS. 1 and 2 and transported upward in FIGS. 1 and 2 to be delivered to the face down tray (hereinafter, referred to as FD tray) 7 with a surface having the toner image facing downward.

Figure 3:
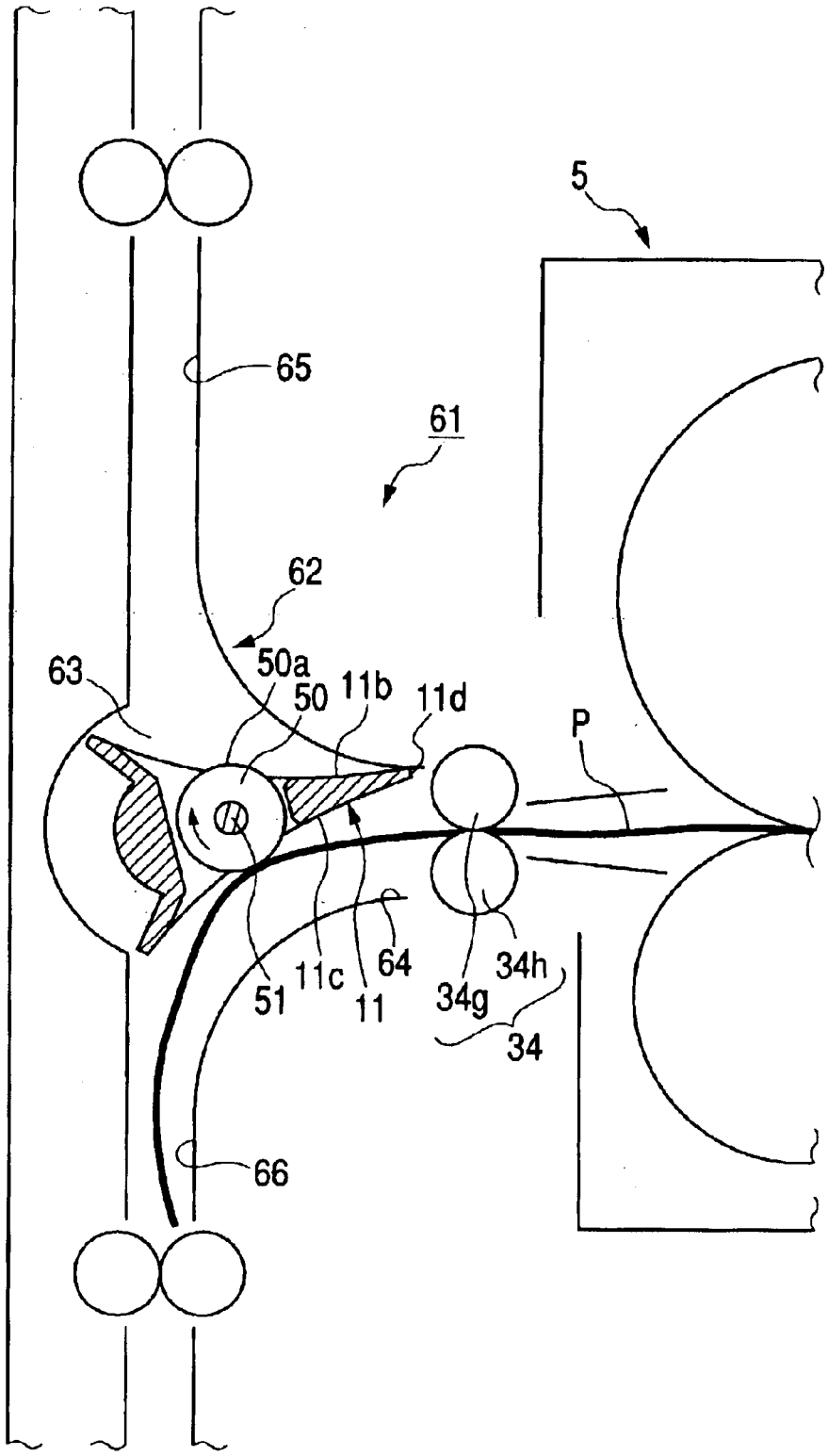
FIG. 3 is a schematic sectional view of the sheet guide device in FIG. 2, and shows a case where the sheet is guided to a surface reverse transport path.

In the case of duplex printing in which a toner image is formed on both surfaces of a sheet, the sheet is guided to the transport path switch gate 11 in a position as indicated in FIG. 3, and transported downward in FIGS. 1 and 3. Then, the sheet is transported in a switch back manner in a surface reverse transport path 19 where a front surface and a back surface of the sheet are reversed, and the sheet is transported to a duplex transport path 20. Further, the sheet is guided along the duplex transport path 20 and again passed through the image forming portion 3 and the fixing device 5. At this time, the sheet is guided upward by the transport path switch gate 11 in the shifted position as indicated in FIGS. 1 and 2. Finally, the sheet is delivered to the FD tray 7.

(Sheet Feed Portion)

The sheets P contained in a sheet cassette 22 that is disposed in a lower part of the apparatus main body 1 are sent out to a transport roller pair 9 by rotation of a pickup roller 8 contacting the sheets P. When being sent out from the sheet cassette 22 by the pickup roller 8, the sheets P are separated into one sheet by separation means (not shown) (for example, a separation claw, a separation pad, or a reversal roller). Then, the sheet P is transported to a registration roller pair 10 disposed in the vicinity of an entrance to the image forming portion 3 by the transport roller pair 9.

In the registration roller pair 10, skew feed of the transported sheet P is corrected to straight feed, and in order to be matched with a timing at which an image is formed in the image forming portion 3, the sheet is temporarily stopped. The sheet P whose skew feed has been corrected by the registration roller pair 10 and whose timing has been adjusted to be matched with that of the image forming portion 3 is then transported to the image forming portion 3 by rotational movement of the registration roller pair 10.

(Image Forming Portion)

The image forming portion 3 utilizing an electrophotographic process is composed of: a laser scanner 13 that irradiates laser light based on image data that is inputted to a printer 52; a photosensitive drum 14 that serves as an image bearing member; a primary charger 12 that uniformly charges a surface of the photosensitive drum 14; a developing device 16 that visualizes an image by attracting toner to an electrostatic latent image formed on the photosensitive drum 14; a transfer blade 17 that transfers a toner image formed on the photosensitive drum 14 onto the sheet P; a cleaning device 18 that removes toner remaining on the photosensitive drum 14 to clean the photosensitive drum 14 for succeeding image forming operation; and the like. In the printer 52 functioning as a multi-color printer, these mechanisms are arranged so as to correspond to each of colors, for example, yellow, magenta, cyan, and black in order from the right of FIG. 1.

After an image forming operation of the printer 52 is started, the primary charger 12 uniformly charges the surface of the photosensitive drum 14. Laser light from the laser scanner 13 is irradiated onto the charged photosensitive drum 14 to write image data onto the photosensitive drum 14. As a result, an electrostatic latent image is formed on the photosensitive drum 14. The developing device 16 attracts toner to the photosensitive drum 14 on which the electrostatic latent image has been formed, so that a toner image to be transferred onto the sheet is formed on the surface of the photosensitive drum 14. The forming of the toner image is performed on the photosensitive drums for the respective colors of yellow, magenta, cyan, and black so as to be matched with the timing of the sheet.

The sheet P that is transported from the registration roller pair 10 at a timing adjusted to be synchronized with the above-mentioned image forming operation is then attracted to and transported by a transfer belt 32, while the respective color toner images formed on the photosensitive drums 14 are successively superimposed and transferred thereonto by the respective transfer blades 17. Excess toner remaining on the surface of the respective photosensitive drums 14 and the like are removed by the cleaning device 18, so that the photosensitive drums 14 become clean to be ready for another image forming operation.

(Fixing Device)

In the fixing device 5, the sheet P onto which the toner image has been transferred is nipped by the fixing roller pair 33 heated by a heater (not shown). Heat and pressure are applied to the sheet to fuse the toner. As a result, the toner image is fixed to the surface of the sheet substantially permanently.

(Face Down Delivery of the Sheet (Hereinafter, Referred to as FD Delivery))

Immediately after the sheet P has been passed through the fixing roller pair 33, the sheet P is bent and transported with its transport direction being shifted upward by approximately 90 degrees by the transport path switch gate 11 in the position as indicated in FIGS. 1 and 2. Then, the sheet P is delivered from a face down delivery roller pair (hereinafter, referred to as FD delivery roller pair) 37 to the FD tray 7.

(Time of Duplex Transport)

At the time of duplex transport, immediately after the sheet P has been passed through the fixing roller pair 33, the sheet P is bent and transported with its transport direction being shifted downward by the transport path switch gate 11 in the position as indicated in FIG. 3. Thereafter, the sheet P is transported in a switch back manner in the surface reverse transport path 19, and a front surface and a back surface thereof are reversed. Then, the sheet is transported along the duplex transport path 20 to join in the transport path lead from the sheet feed portion 2. After the other surface of the sheet is subjected to the same process as that for the first surface, a toner image is formed on the other surface as well. Accordingly, toner images are formed on both surfaces of the sheet. The sheet whose surfaces both have a toner image formed thereon is passed through the fixing device 5. At this time, the sheet transport direction is shifted upward by the transport path switch gate 11 in the shifted position as indicated in FIGS. 1 and 2. Then, the sheet is delivered from the FD delivery roller pair 37 to the FD tray 7.

(Sheet Guide Device of Embodiment 1)

As shown in FIGS. 2 and 3, the sheet guide device 61 is composed of: a two-forked sheet guide path 62 that is branched off into two forks from a sheet guide path that guides a sheet; the transport path switch gate 11 that is disposed in a branch-off portion 63 of the two-forked sheet guide path 62 in a rotatable manner and serves as a guide member for selectively guiding the sheet to a face down delivery path (hereinafter, referred to as FD delivery path) 65 and a re-transport path 66 which serve as respective sheet guide paths of the two-forked sheet guide path 62; a roller 50 that is disposed in the transport path switch gate 11 so as to be rotatable in the sheet transport direction of the sheet P and serves as a guide rotary member; and the like.

The two-forked sheet guide path 62 is formed into an inverted T-shape by branching off a fixing delivery path 64 on a downstream side of the fixing device 5 into two sheet guide paths containing the FD delivery path 65 and the re-transport path 66. That is, the FD delivery path 65 and the re-transport path 66 which are branched off from the fixing delivery path 64 are formed substantially in a straight line by being bent in a direction different from each other by approximately 90 degrees with respect to the fixing delivery path 64 that has not yet been branched off.

Figure 4:
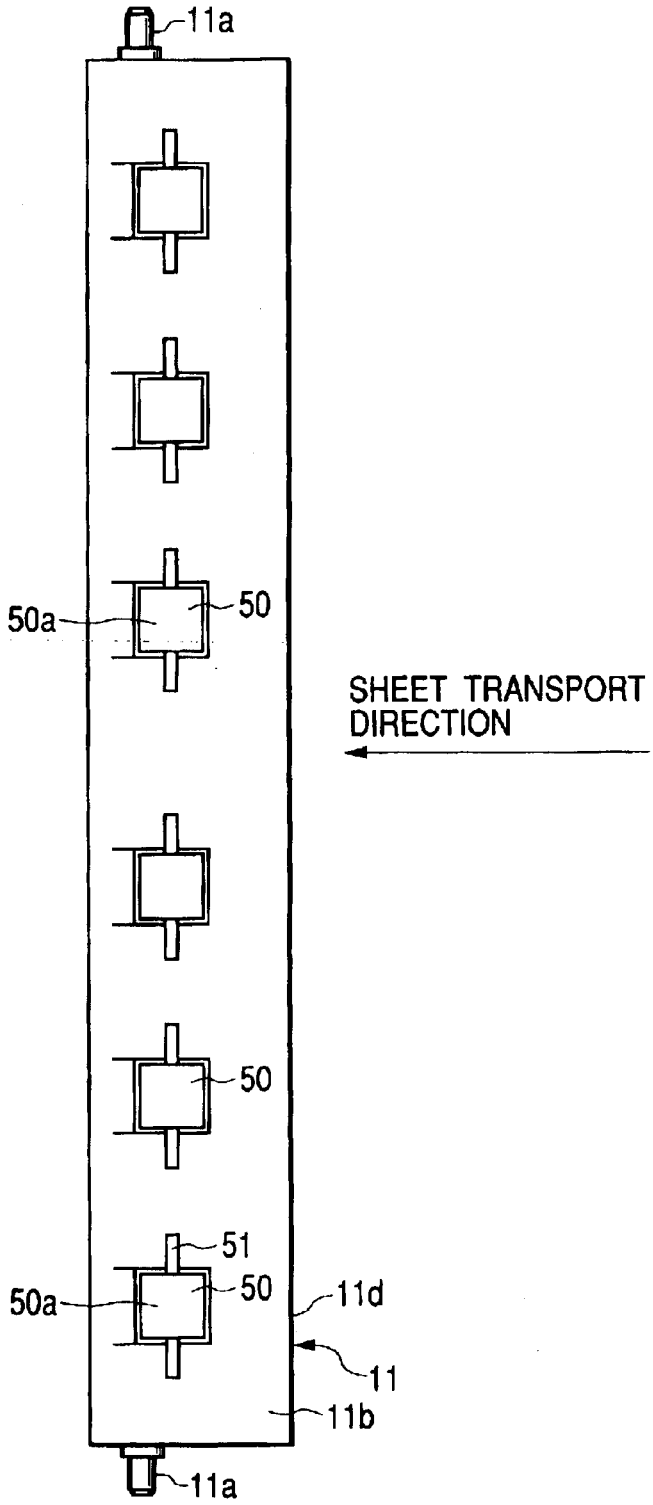
FIG. 4 is a plan view of a transport path switch gate in the sheet guide device of Embodiment 1.

The transport path switch gate 11 is formed to have a larger length in a direction crossing the sheet transport direction as shown in FIG. 4 and disposed in the branch-off portion 63 so as to be rotatable about rotational supports 11*a* that are protruded from both ends of the transport path switch gate 11 in the length direction. Also, the transport path switch gate 11 is formed to have a substantially acute-angled triangle shape in its section taken along the sheet transport direction as shown in FIGS. 1 to 3, and a distal end 11*d* corresponding to a vertex of the acute-angled triangle is admitted into the fixing delivery path 64 on the downstream side of the fixing device 5.

A sheet guide surface 11*b* on an upper surface side of the transport path switch gate 11 is formed into a concave surface recessed to some extent so as to smoothly guide the sheet transported from the fixing delivery path 64 to the FD delivery path 65. Similarly, a sheet guide surface 11*c* on an lower surface side of the transport path switch gate 11 is also formed into the concave surface recessed to some extent so as to smoothly guide the sheet transported from the fixing delivery path 64 to the re-transport path 66. The transport path switch gate 11 is structured to be rotated by a drive portion (not shown) such as a motor and a plunger.

Further, in the transport path switch gate 11, a plurality of the rollers 50 are arranged so as to be rotatable about a roller shaft 51 fixed to the transport path switch gate 11. A rotational surface 50*a* of the roller 50 is protruded from the sheet guide surfaces 11*b* and 11*c* that guide the sheet in the transport path switch gate 11.

As shown in FIG. 4, the roller shaft 51 of the rollers 50 is disposed on an upstream side of the rotational supports 11*a* of the transport path switch gate 11 in the sheet transport direction. In addition, the plurality of the rollers 50 are arranged in the axial direction.

Figure 6:
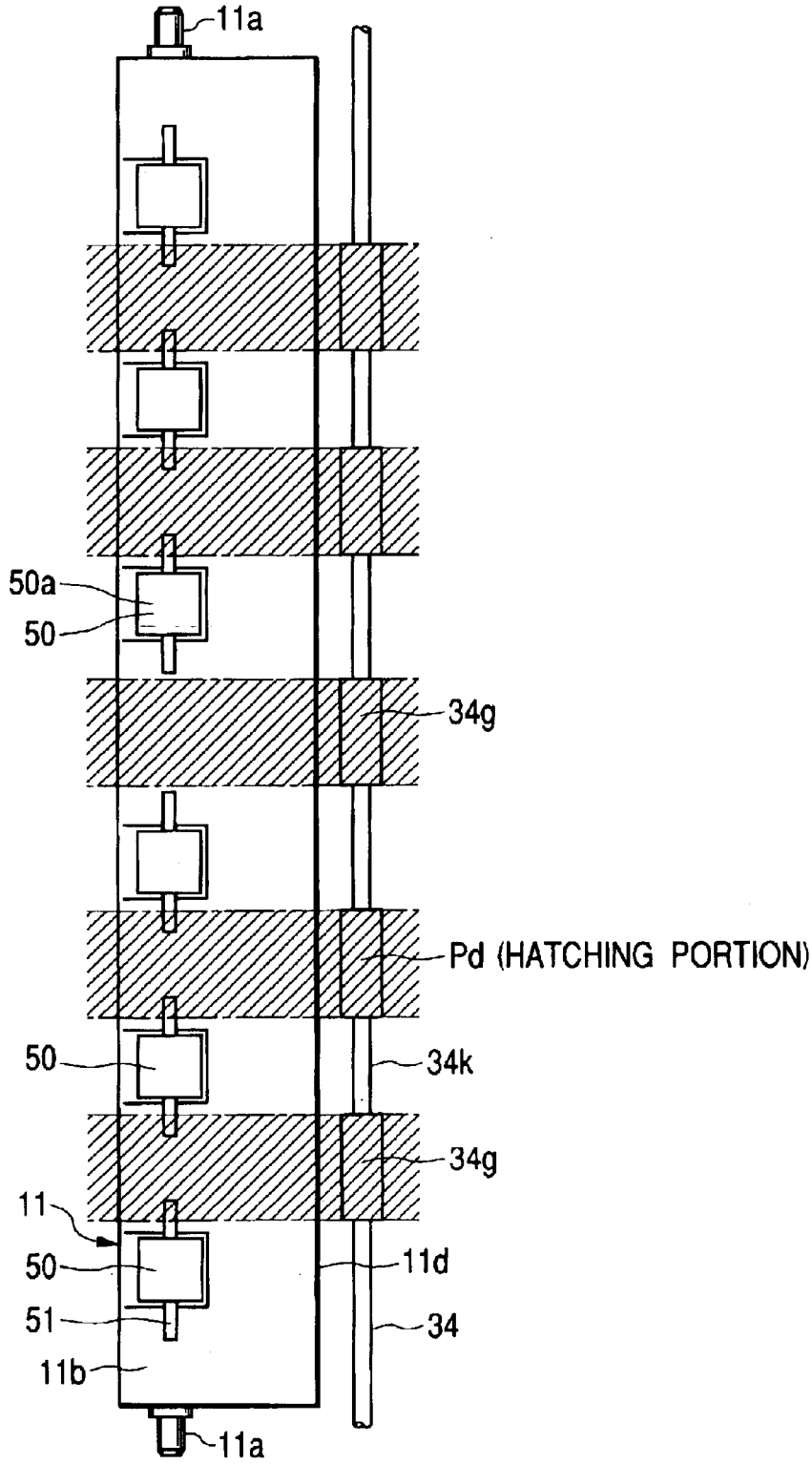
FIG. 6 is a plan view of a transport path switch gate according to another embodiment in the sheet guide device of Embodiment 1.

Note that, as shown in FIG. 6, the roller shaft 51 of the rollers 50 may be disposed so as to be aligned and coaxial with the rotational supports 11*a* of the transport path switch gate 11.

Figure 7:
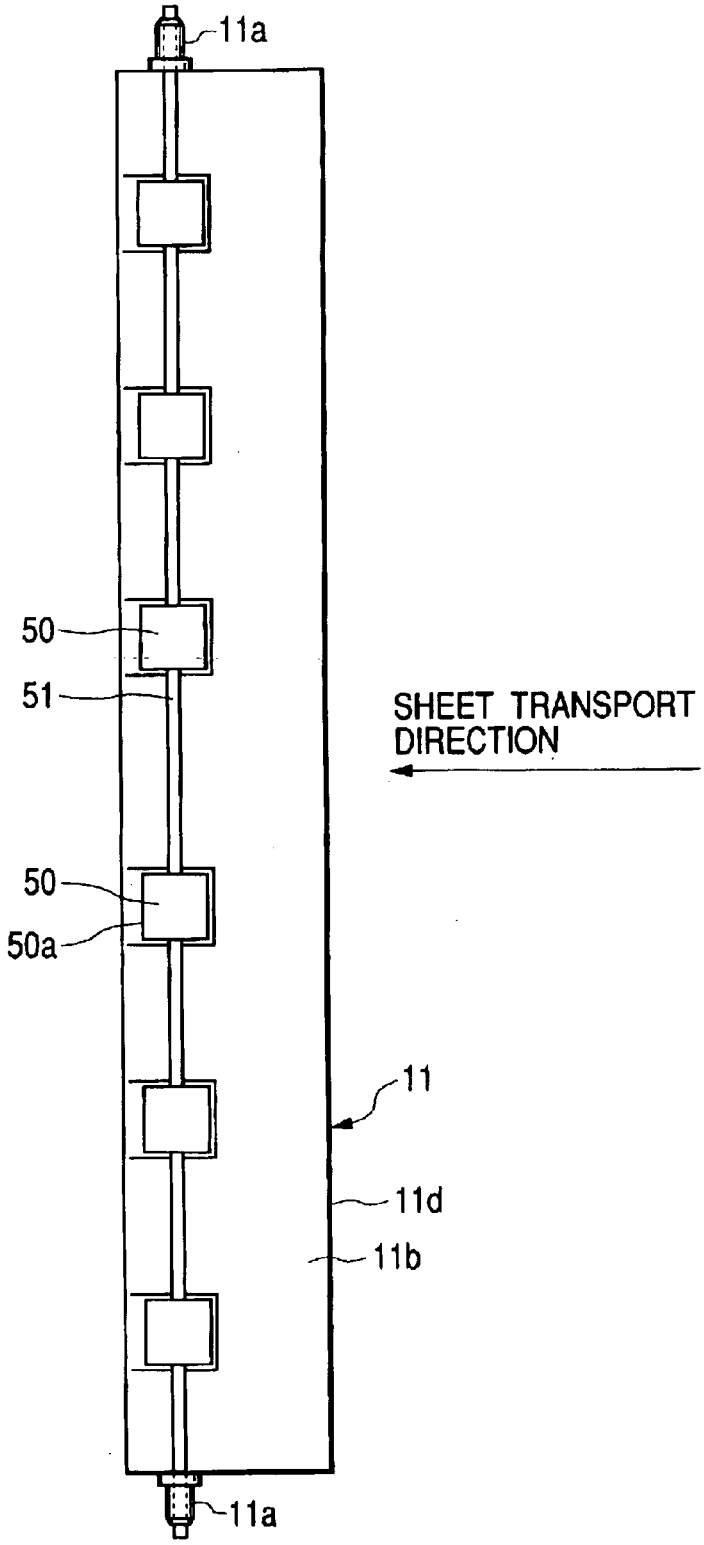
FIG. 7 is a plan view of a transport path switch gate according to still another embodiment in the sheet guide device of Embodiment 1.

Alternatively, as shown in FIG. 7, by using the roller shaft 51 provided by one and the rotational supports 11*a* formed into hollow shapes, the roller shaft 51 may be rotatably supported by the rotational supports 11*a*. Further, by using the rotational supports 11*a* having through holes, the roller shaft 51 may be supported by fixed members on side surfaces of the apparatus main body. In the case of the structure as shown in FIG. 7, the rollers 50 are not supported by the transport path switch gate 11. Moreover, the plurality of the rollers 50 are shown to be arranged in the axial direction, while a single long-sized roller having a large length in the axial direction may be used. Note that, in the case where the roller shaft 51 is rotatably supported by the rotational supports 11*a* or the fixed members, the roller 50 may be rotatably attached to the roller shaft 51 or may instead be fixed to the roller shaft 51.

In the structure as described above, the rotational surface 50*a* of the roller 50 is protruded from the sheet guide surfaces 11*b* and 11*c* of the transport path switch gate 11. Accordingly, the sheet P abuts against the rotational surface 50*a* of the roller 50 on the transport path switch gate 11 in either of the following cases: the case where a high density image is transferred onto the first surface of the sheet P, and immediately after being passed through the fixing device 5, as shown in FIG. 3, the sheet P is bent and transported to the re-transport path 66 leading downward by approximately 90 degrees; and the case where a high density image is transferred onto and fixed to the first surface of the sheet P, the sheet P is guided by the transport path switch gate 11 to be transported to the surface reverse transport path and duplex transport path, a toner image is transferred onto the second surface of the sheet P, and immediately after being passed through the fixing device 5 again, as shown in FIG. 2, the sheet P is bent and transported to the FD delivery path 65 leading upward by approximately 90 degrees.

Therefore, in the sheet guide device 61, even if the toner of the high density toner image is not yet completely cooled down to become hard, the roller 50 can prevent the sheet from adhering to the sheet guide surfaces 11*b* and 11*c* of the transport path switch gate 11.

Also, in the sheet guide device 61, the roller 50 is structured to be rotatable. Thus, the roller 50 is rotated in association with a toner surface on which the toner image has been formed, thereby causing no image defect such as a wear mark or a streaked image on the toner surface.

Further, in the sheet guide device 61, in either case where the sheet P is guided upward to the FD delivery path 65 by the transport path switch gate 11 as shown in FIG. 2 or guided downward to the re-transport path 66 by the transport path switch gate 11 as shown in FIG. 3, even if a high density image is printed on the surface of the sheet to be guided by the transport path switch gate 11, the sheet can be smoothly guided by one roller 50. Therefore, the roller 50 also serves to prevent the sheet from adhering to both surfaces of the sheet guide surfaces 11*b* and 11*c* of the transport path switch gate 11, thereby making it possible to reduce the costs of the sheet guide device 61.

Note that the rotational surface 50*a* on the outer circumference of the roller 50 is formed of fluoroplastic to which toner hardly adheres. That is, the entirety of the roller 50 may be a fluoroplastic molding. Alternatively, the roller 50 may be a two color molding in which an inexpensive material other than fluoroplastic is used as a base material (content) and the outer circumferential surface of the base material is coated with fluoroplastic. Further, the roller 50 may be structured such that the base material (content) is formed of an inexpensive material other than fluoroplastic and the outer circumferential surface of the base material is coated with fluoroplastic by covering the outer circumferential surface of the base material with a tube made of fluoroplastic. As a result, by using fluoroplastic for the rotational surface 50*a* of the roller 50, the adhesion of the toner surface thereto can be prevented more reliably.

In addition, as described above, fluoroplastic is used as the material for forming the peripheral portion of the distal end 11*d* or the overall outer circumferential surface of the transport path switch gate 11 which has the possibility of contacting the sheet. As a result, the adhesion of the toner surface thereto can be prevented still more reliably.

Also, the roller shaft 51 is not disposed on the sheet guide surface 11*b* (or the sheet guide surface 11*c*) of the transport path switch gate 11, but included within a range of the thickness of the transport path switch gate 11. As a result, the amount by which the rotational surface 50*a* of the roller 50 is protruded from the transport path switch gate 11 is not more than the radius of the roller 50, thereby preventing the sheet from being caught on the roller 50.

Figure 5:
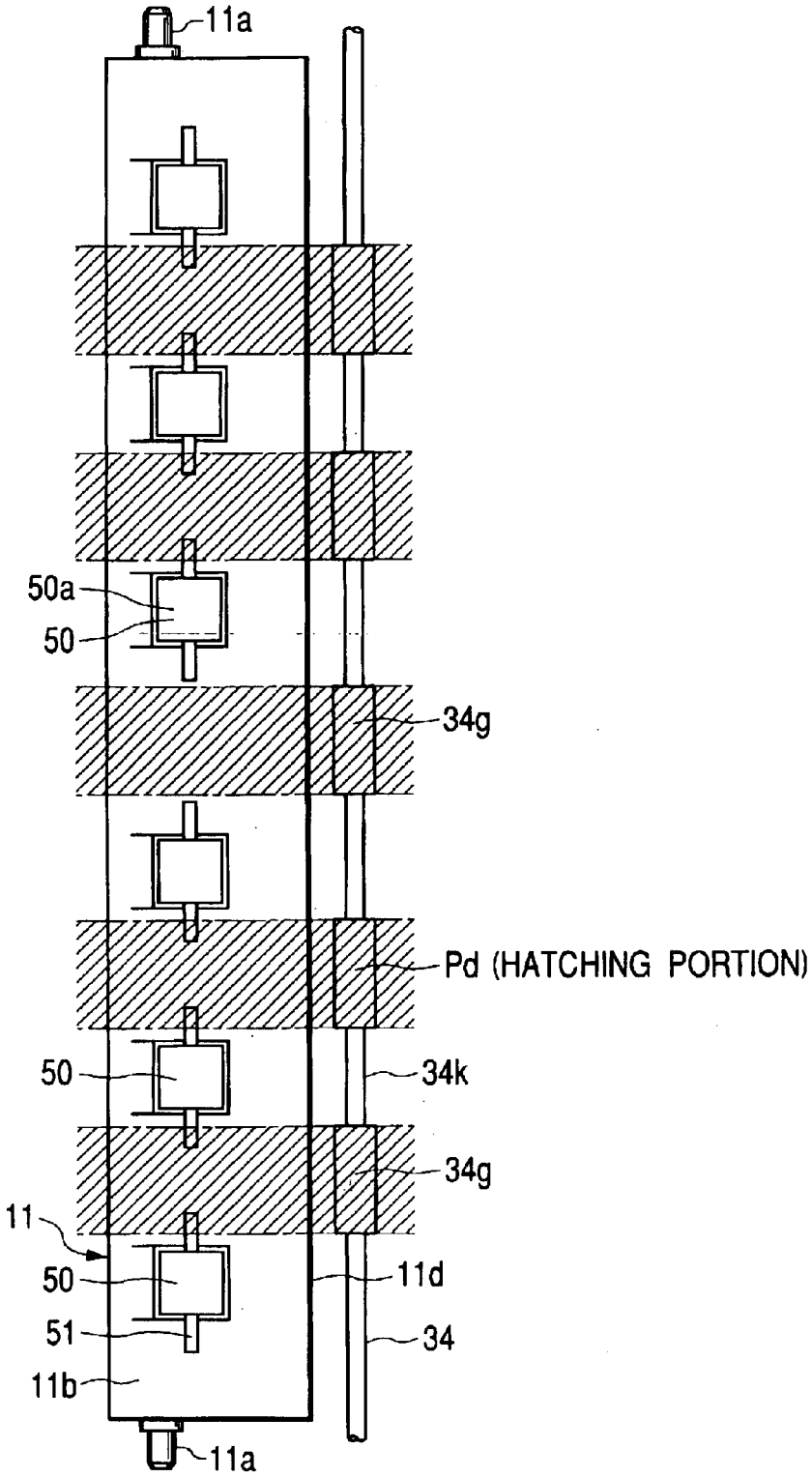
FIG. 5 is a plan view showing a positional relationship between rollers of the sheet guide device of Embodiment 1 and drive side roller members of fixing delivery roller pairs.

Next, a description will be made of the arrangement of the rollers 50 in the axial direction (in the length direction). A fixing delivery roller pair 34 disposed in an outlet portion of the fixing device 5 is composed of a pair of rollers 34*g* and 34*h*. As shown in FIG. 5, generally, the roller 34*g* on the drive side is formed of rubber and a plurality of the rollers 34*g* are press-fitted onto a common metal shaft 34*k*. As shown in FIGS. 2 and 3, the roller 34*h* on the driven side is a roller formed of resin, rubber, or metal to be used in a pair with the roller 34*g* on the drive side. A plurality of the rollers 50 disposed in the transport path switch gate 11 are arranged in the axial direction. However, the plurality of the rollers 50 are disposed in portions where the roller 34*g* on the drive side and the roller 34*h* on the driven side are not disposed in the length direction of the fixing delivery rollers. That is, the rollers 50 and the rollers 34*g* and 34*h* are disposed in different positions in the axial direction.

The reason why the rollers 50 and the rollers 34*g* and 34*h* are disposed alternately is as follows. That is, on the toner surface of the sheet on which a toner image has been formed, portions abutted against the fixing delivery roller pairs 34 are deprived of heat by the fixing delivery roller pairs 34 to lower their temperature. Thus, these areas (hatching portions Pd in FIG. 5) of the sheet are difficult to adhere to the transport path switch gate 11. Therefore, the rollers 50 are disposed in portions other than the hatching portions Pd which are easy to adhere to the transport path switch gate 11. As a result, the number of the rollers 50 to be disposed becomes minimum and the sheet is not adhered to the transport path switch gate 11, thereby making it possible to reduce the costs.

(Sheet Guide Device of Embodiment 2)

Figure 8:
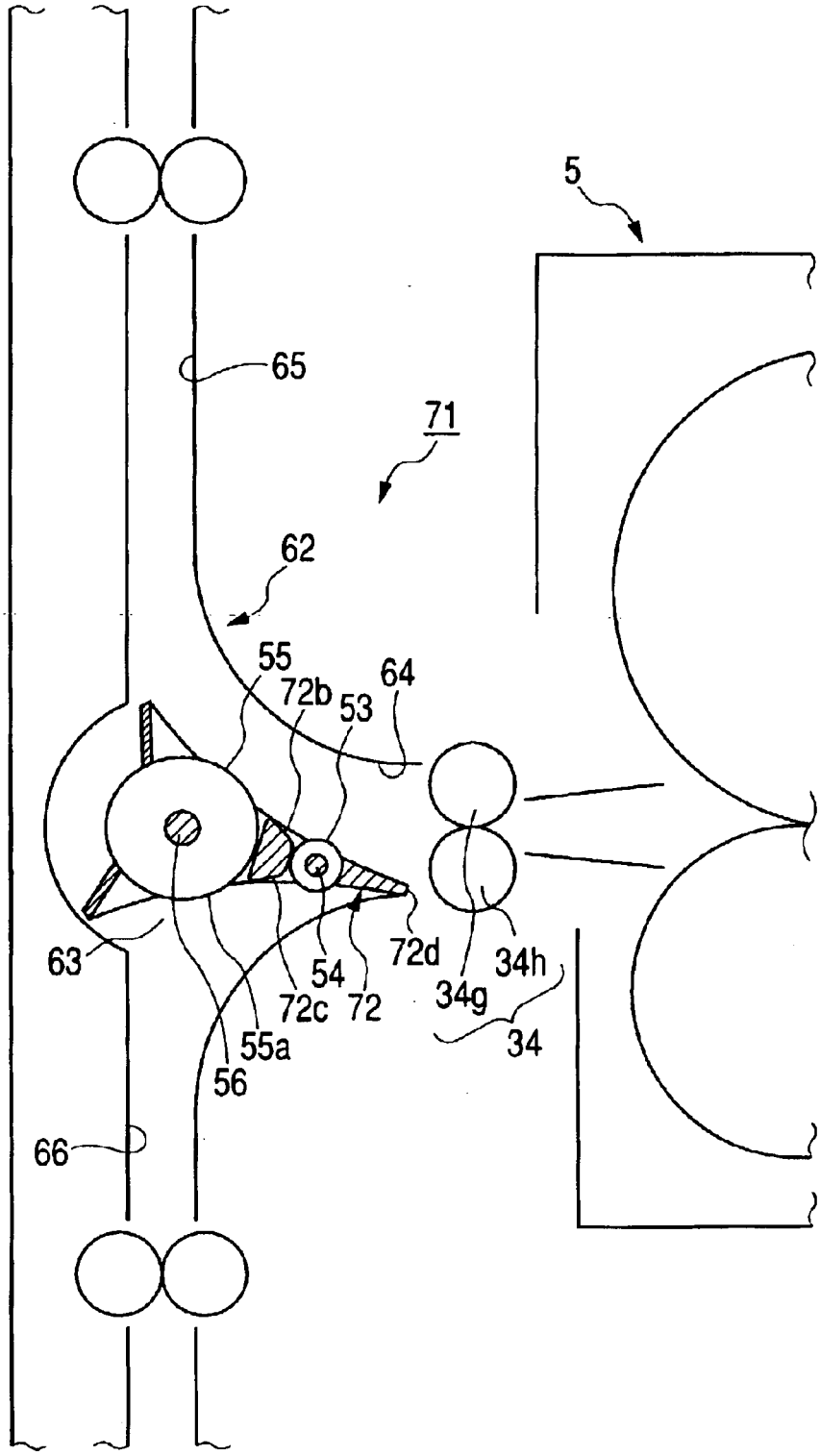
FIG. 8 is a schematic sectional view of a sheet guide device according to Embodiment 2 of the present invention which is taken along a sheet transport direction, and shows a case where a sheet (not shown) is guided to a face down tray.
Figure 9:
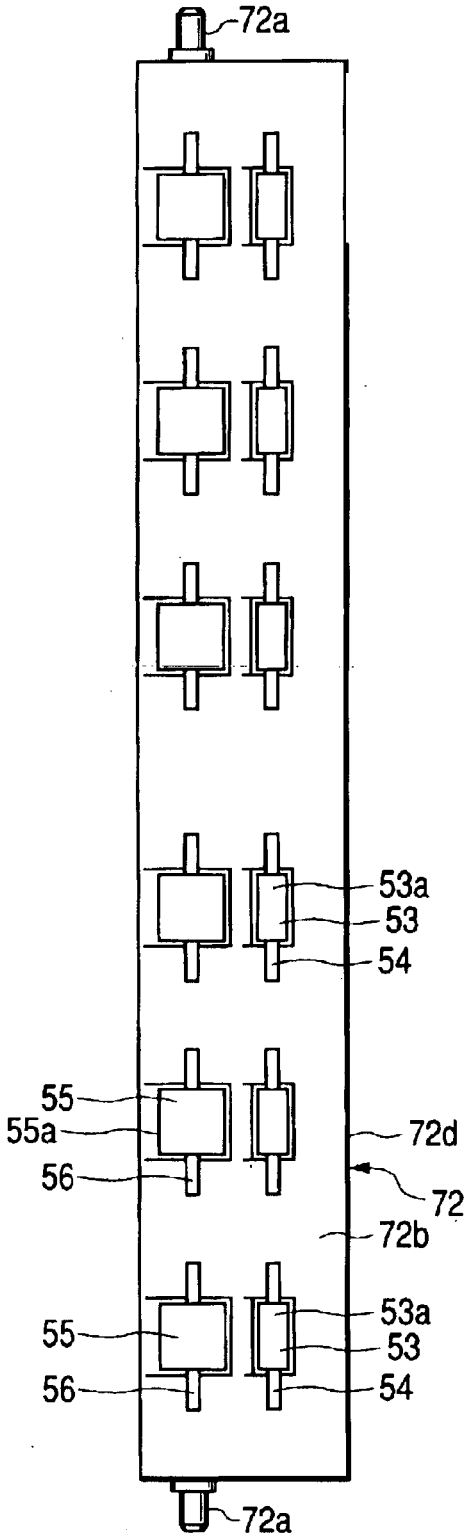
FIG. 9 is a plan view of a transport path switch gate in the sheet guide device of Embodiment 2.
Figure 10:
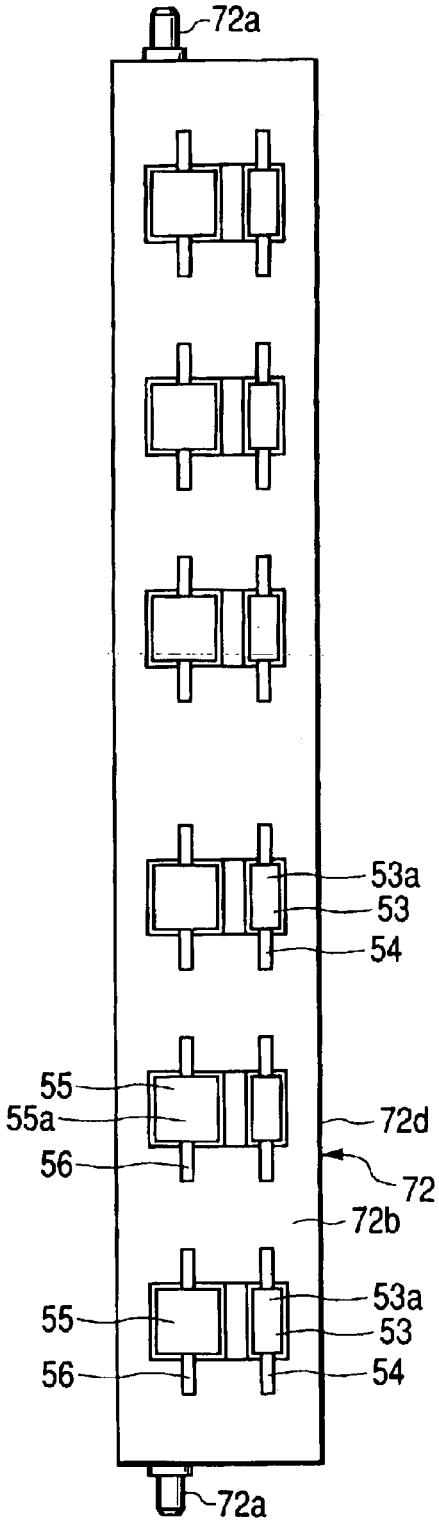
FIG. 10 is a plan view of a transport path switch gate according to another embodiment in the sheet guide device of Embodiment 2.
Figure 11:
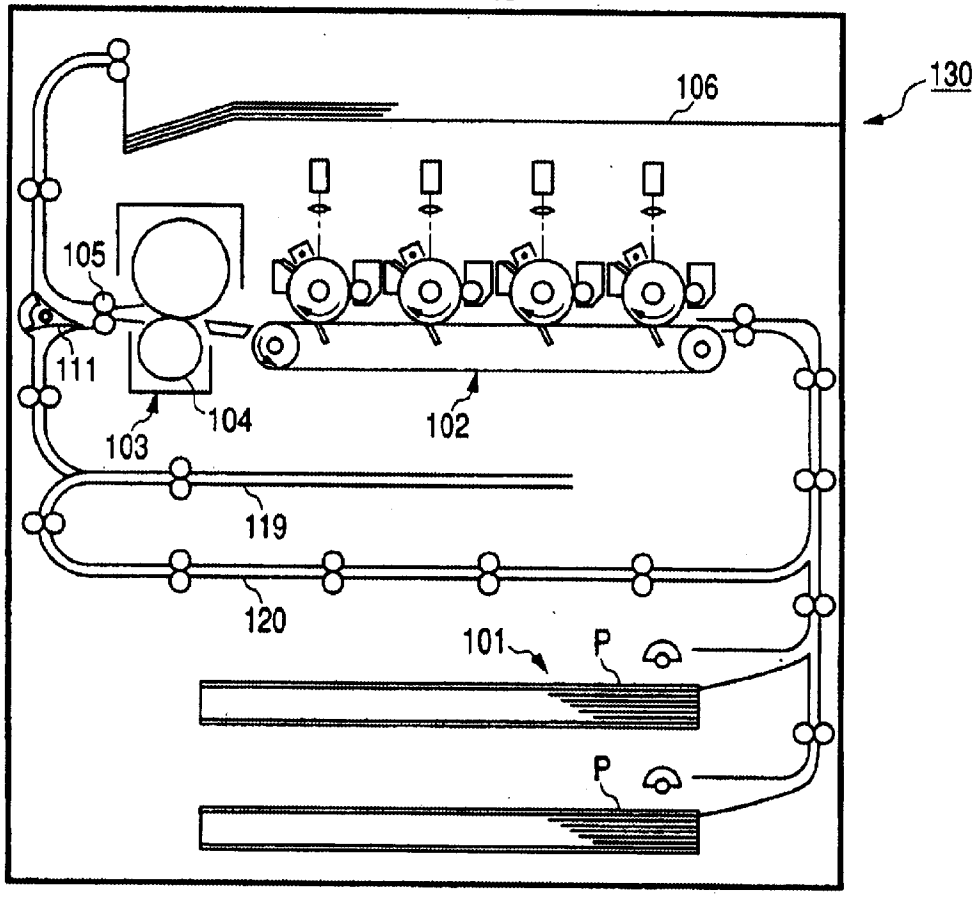
FIG. 11 PRIOR ART
FIG. 11 is a schematic sectional view of a printer taken along a sheet transport direction, the printer being provided in an apparatus main body thereof with a conventional sheet guide device.
Figure 12:
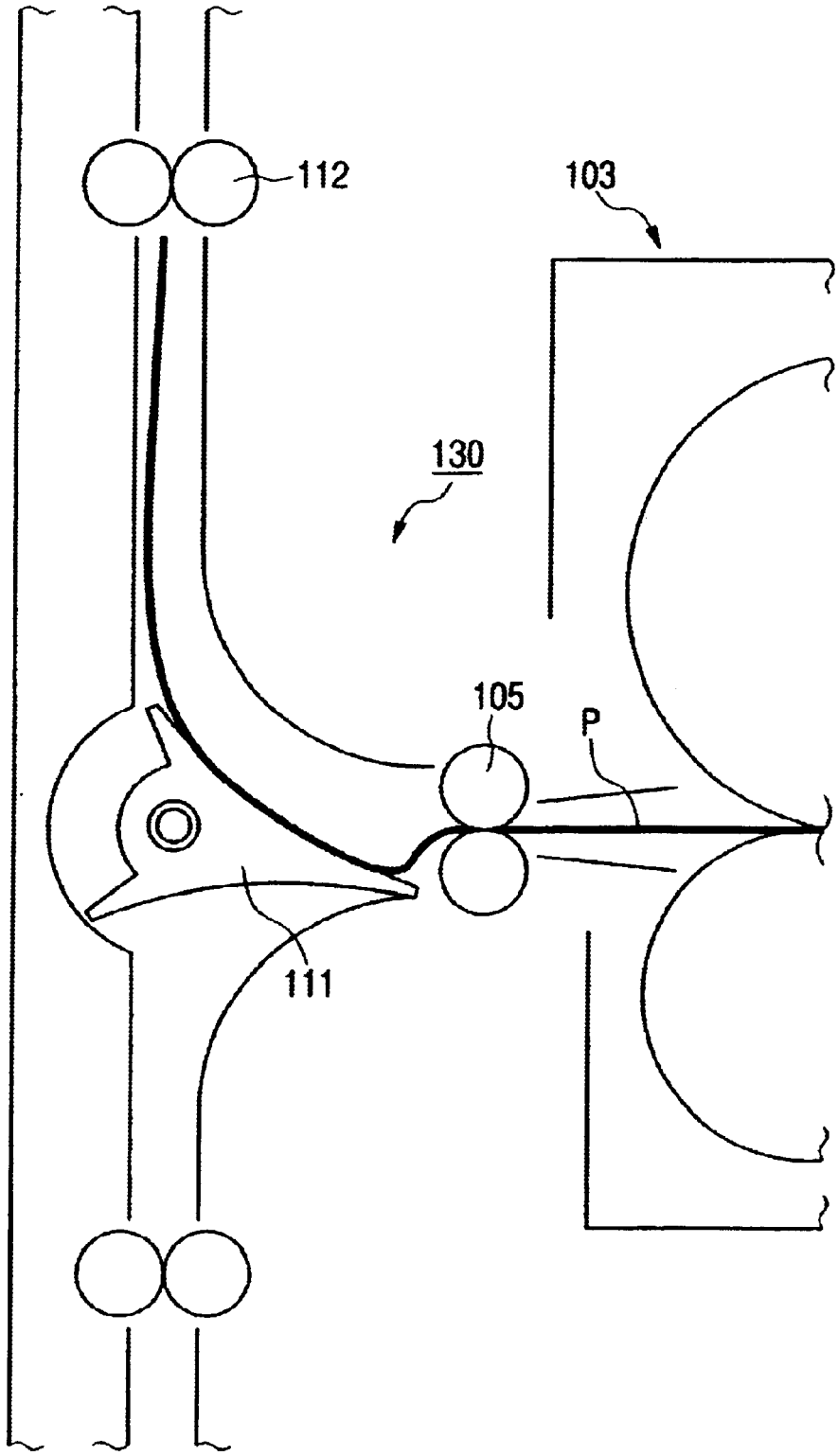
FIG. 12 PRIOR ART
FIG. 12 is a schematic sectional view of the conventional sheet guide device taken along the sheet transport direction, and shows a case where a sheet is guided to a face down tray.
Figure 13:
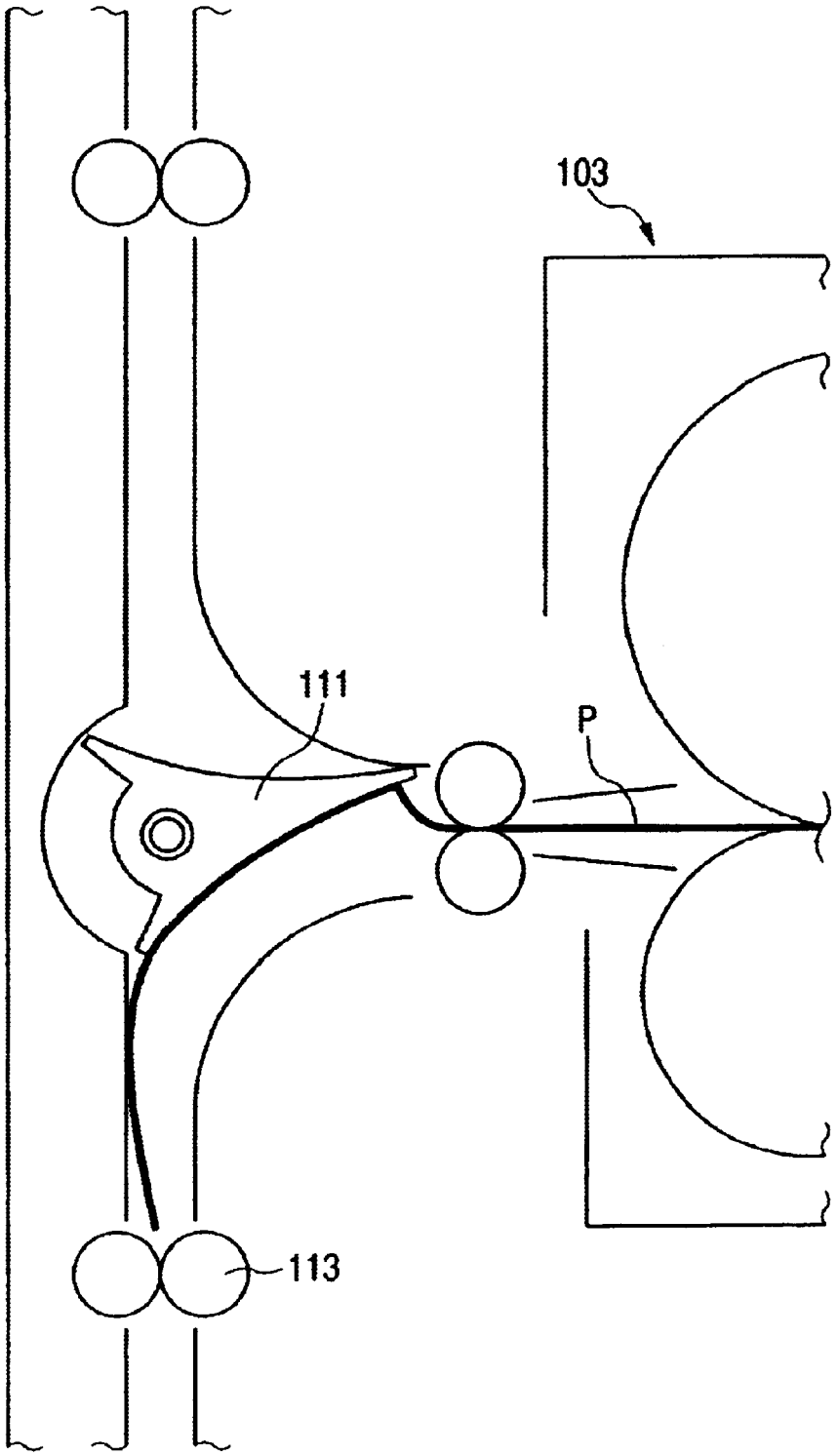
FIG. 13 PRIOR ART
FIG. 13 is a schematic sectional view of the sheet guide device in FIG. 12, and shows a case where the sheet is guided to a surface reverse transport path.

As described above, the sheet guide device 61 according to Embodiment 1 includes only one line of the rollers 50. However, in a sheet guide device 71 according to Embodiment 2 as shown in FIGS. 8 to 10, two lines of first rollers 53 and second rollers 55 which serve as the guide rotary members are rotatably supported by a transport path switch gate 72 serving as the guide member such that the two lines are disposed in different positions in the sheet transport direction. Note that, in the sheet guide device 71 of Embodiment 2, the same parts as those in the sheet guide device 61 of Embodiment 1 are denoted by the same symbols and their descriptions will be omitted.

Also, the transport path switch gate 72 in the sheet guide device 71 of Embodiment 2 has substantially the same shape as the transport path switch gate 11 in the sheet guide device 61 of Embodiment 1. Thus, the same parts are denoted by the same symbols except that the reference numeral "11" in the transport path switch gate 11 is replaced with "72" and the descriptions of the same parts will be omitted.

A plurality of the first rollers 53 and a plurality of the second rollers 55 are rotatably supported by roller shafts 54 and 56 in the transport path switch gate 72, respectively, and arranged in the respective axial directions. A rotational surface 53*a* of the first roller 53 and a rotational surface 55*a* of the second roller 55 are also protruded from a sheet guide surface 72*b* on an upper surface side of the transport path switch gate 72 and a sheet guide surface 72*c* on an lower surface side of the transport path switch gate 72, respectively. As shown in FIG. 9, the roller shaft 56 is disposed so as to be aligned and coaxial with rotational supports 72*a* of the transport path switch gate 72.

Note that the first roller 53 and the second roller 55 are formed of the same materials as described in Embodiment 1.

In this case, for example, as described in Embodiment 1 with reference to FIG. 7, by making the roller shafts 56 into one shaft and the rotational supports 72*a* formed into hollow shapes, the one roller shaft 56 may be rotatably supported by the rotational supports 72*a*. Alternatively, the one roller shaft 56 may extend through the rotational supports 72*a* so that the one roller shaft 56 may be supported by the fixed members on the side surfaces of the apparatus main body. In this case, the rollers 55 are not supported by the transport path switch gate 72. Note that, in the case where the roller shaft 56 is rotatably supported by the rotational supports 72*a* or the fixed members, the roller 55 may be rotatably attached to the roller shaft 56 or may instead be fixed to the roller shaft 56.

Note that, as shown in FIG. 10, the roller shaft 56 may be disposed on an upstream side of the rotational supports 72*a* of the transport path switch gate 72 in the sheet transport direction. The roller shaft 54 as shown in FIGS. 9 and 10 are disposed on an upstream side of the rotational supports 72*a* in the sheet transport direction.

The rotational surface 53*a* of the first roller 53 and the rotational surface 55*a* of the second roller 55 also contain fluoroplastic. In addition, the first rollers 53 and the second rollers 55 are, for example, as shown in FIG. 5, disposed in positions different from the rollers 34*g* and 34*h* in the axial direction. Therefore, the same effects as described in Embodiment 1 can be achieved.

Accordingly, in the sheet guide device 71 of Embodiment 2, the first rollers 53 and the second rollers 55 are disposed in two lines in the sheet transport direction in the transport path switch gate 72, thereby increasing areas in which the sheet P abuts against the rollers. As a result, the adhesion of the toner surface of the sheet to the transport path switch gate 72 can be prevented more effectively.

Note that the rollers may be disposed not only in two lines but also in more lines.

The sheet guide device of the present invention includes the guide rotary member in the branch-off portion of the branch-off sheet guide path, so that, for example, even the toner surface of the sheet guided when the high density image is printed in the image forming apparatus rarely adheres to the guide member. Consequently, the failure in guiding the sheet is effectively prevented at minimum costs as needed.

What is claimed is:

1. A sheet guide device comprising:

a branch-off sheet guide path that is branched off from a sheet guide path that guides a sheet;

a guide member that is rotatably disposed in a branch-off portion of the branch-off sheet guide path and selectively guides the sheet to respective sheet guide paths that are branched off in the branch-off sheet guide path; and a guide rotary member that is located in the branch-off portion and rotatable in a sheet transport direction, wherein a rotational surface of the guide rotary member is protruded from a sheet guide surface of the guide member which guides the sheet.

2. A sheet guide device according to claim 1, wherein rotation centers of the guide member and the guide rotary member are aligned with each other on one axial line.

3. A sheet guide device according to claim 2, wherein the guide rotary member is rotatably supported by the guide member.

4. A sheet guide device according to claim 2, wherein the guide rotary member is rotatably supported by an apparatus main body.

5. A sheet guide device according to claim 2, wherein:

the guide member includes two sheet guide surfaces that selectively guides the sheet to the sheet guide paths; and the rotational surface of the guide rotary member is protruded from the two sheet guide surfaces.

6. A sheet guide device according to claim 2, wherein a plurality of the guide rotary members are arranged in an axial direction thereof.

7. A sheet guide device according to claim 1, wherein a plurality of the guide rotary members are arranged in parallel in the sheet transport direction.

8. A sheet guide device according to claim 7, wherein rotation centers of one guide rotary member among the plurality of the guide rotary members and the guide member are aligned with each other on one axial line.

9. A sheet guide device according to claim 1, wherein the rotational surface of the guide rotary member contains fluoroplastic.

10. An image forming apparatus comprising:

a branch-off sheet guide path that is branched off from a sheet guide path that guides a sheet;

a guide member that is rotatably disposed in a branch-off portion of the branch-off sheet guide path and selectively guides the sheet to respective sheet guide paths that are branched off in the branch-off sheet guide path; and a guide rotary member that is located in the branch-off portion and rotatable in a sheet transport direction, wherein a rotational surface of the guide rotary member is protruded from a sheet guide surface of the guide member which guides the sheet.

11. An image forming apparatus comprising:

image forming means for forming a toner image on a sheet;

fixing means for fixing the toner image to the sheet on which the toner image has been formed by the image forming means;

a branch-off sheet guide path that is branched off from a sheet guide path that guides the sheet on a downstream side of the fixing means;

a guide member that is rotatably disposed in a branch-off portion of the branch-off sheet guide path and selectively guides the sheet to respective sheet guide paths that are branched off in the branch-off sheet guide path; and a guide rotary member that is located in the branch-off portion and rotatable in a sheet transport direction, wherein a rotational surface of the guide rotary member is protruded from a sheet guide surface of the guide member which guides the sheet.

12. An image forming apparatus according to claim 11, wherein:

a plurality of the guide rotary members are arranged in an axial direction thereof;

a plurality of transport rollers that serve to transport the sheet between the fixing means and the guide member are arranged in an axial direction thereof; and the guide rotary members and the transport rollers are arranged in different positions in the axial directions.

13. An image forming apparatus according to claim 12, wherein rotation centers of the guide member and the guide rotary members are aligned with each other on one axial line.

* * * * *

UNITED STATES PATENT AND TRADEMARK OFFICE

CERTIFICATE OF CORRECTION

PATENT NO. : 6,764,236 B2
DATED : July 20, 2004
INVENTOR(S) : Kenji Suzuki

It is certified that error appears in the above-identified patent and that said Letters Patent is hereby corrected as shown below:

Column 2,
Line 31, “in” should be deleted.

Column 7,
Line 45, “an” should read -- a --.

Column 10,
Line 36, “shaft” should read -- shafts --.

Column 11,
Line 22, “guides” should read -- guide --.

Signed and Sealed this

Thirtieth Day of November, 2004

JON W. DUDAS
*Director of the United States Patent and Trademark Office*